United States Patent [19]

Schwartz

[11] Patent Number: 4,488,135

[45] Date of Patent: Dec. 11, 1984

[54] TRANSFORMER FOR WELDING GUN

[76] Inventor: Charles A. Schwartz, 24545 Bryden Rd., Beachwood, Ohio 44122

[21] Appl. No.: 472,596

[22] Filed: Mar. 7, 1983

Related U.S. Application Data

[63] Continuation-in-part of Ser. No. 402,890, Jul. 29, 1982.

[51] Int. Cl.[3] ..... H01F 27/08

[52] U.S. Cl. ..... 336/62; 336/183; 336/223; 336/232

[58] Field of Search ..... 336/62, 183, 232, 223, 336/61, 55

[56] References Cited

U.S. PATENT DOCUMENTS

| | | | |
|---|---|---|---|
| 1,394,044 | 10/1921 | Stephens | 336/62 X |
| 1,936,309 | 11/1933 | Northrup | 336/62 |
| 3,503,026 | 3/1970 | Geisel et al. | 336/62 |
| 3,728,655 | 4/1973 | Reinke | 336/62 |

*Primary Examiner*—A. D. Pellinen
*Assistant Examiner*—Susan Steward
*Attorney, Agent, or Firm*—Cullen, Sloman, Cantor, Grauer, Scott & Rutherford

[57] ABSTRACT

A transformer for a welding gun has a reduced resistance and reactance thus drawing less current. The transformer is of substantially reduced weight and may be operated at high duty cycles and in a welding gun performing a large number of welds per hour. The transformer is formed of a hollow coil and coolant is flowed through the coil to directly cool the primary. The secondary is electrically insulated from the primary but physically adjacent the primary so that heat from the secondary is dissipated through the primary to the contact.

8 Claims, 5 Drawing Figures

TRANSFORMER FOR WELDING GUN

CROSS-REFERENCE TO RELATED APPLICATION

This is a continuation-in-part of my co-pending application Ser. No. 402,890, filed July 29, 1982, entitled "Improved Welding System".

BACKGROUND OF THE INVENTION

The present invention relates to an improved electrical resistance welding gun and, more particularly, to an improved transformer for an electrical resistance welding gun.

Electrical resistance welding is, of course, well-known and electrical resistance welding guns are frequently used in the fabrication of vehicles to weld together parts of the vehicle such as floor pans, fenders, roofs, hoods, doors, frames, etc. Electrical resistance welding guns typically comprise first and second electrodes moveable relative to each other and oppositely disposed relative to one another for welding, with each electrode being attached to a body member (called an arm), and an electrical transformer including primary windings and secondary windings. One type of electrical resistance welding gun provides the transformer at a remote location from the gun itself and the electrical power is coupled to the electrodes by means of an elongated cable. This type of welding gun allows the electrodes to be taken to the workpiece while the transformer is relatively stationary at a location remote from the workpiece. In such a welding system, the majority of the electrical power necessary for the system is lost transferring power from the transformer to the electrodes. That is, the power required to weld the workpiece is normally quite small as compared to the total power requirement of the welding system. Thus in a welding system of the type just described the actual weld (i.e., $I^2R$ between the electrode tips) consumes less than 2 kilowatts, the remainder of the welding gun (excluding the cable) may consume 15–25 kw and the cable itself is a primary source of energy loss such that a ten foot cable may consume as much as 200 kw.

A second type of welding gun utilizes the transformer as a structural part of the arm of the welder. Such a welding gun is disclosed in my U.S. Pat. No. 4,233,488 issued Nov. 11, 1980. Since the transformer is physically adjacent the electrode, a long cable is not necessary. This avoids the problem of power loss due to a long cable from the transformer to the electrode. My aforementioned co-pending application describes an improved transformer which may be utilized as a structural part of the body member or arm of an electrical resistance welding gun.

A third type of electrical resistance welding gun uses a transformer attached to the arm or body member of the welding gun, rather than as a structural part of the welding gun arm. The transformer is adjacent the electrodes and a long cable is not necessary. Since transformers may burn out, it is beneficial to have a transformer attached to the arm of the welding gun because such transformers may be easily replaced. Also, if the power requirements of the system change, a different capacity transformer may be readily attached to the arm of the welding gun.

While a basic objective in an electrical resistance welding gun is to conserve energy by the reduction of line current, there are various conflicting sub-problems which occur. Specifically, the minimum line current necessary for welding is related to the load current needed for welding in proportion to the transformer "turns ratio", which is the ratio of the number of primary turns to the number of secondary turns. To minimize line current, a higher "turns ratio" is needed. However, in order to provide a sufficient secondary voltage to overcome the total impedance of the system, a lower "turns ratio" is needed. But, once a lower "turns ratio" is provided, the result is the need for a higher line current.

Thus, the desire to reduce line current has been frustrated by the necessity of a sufficiently high line current in conjunction with a sufficiently low "turns ratio" to provide not only the necessary power for welding but also the necessary secondary voltage to overcome the impedance of the welding system.

A problem which arises with transformers for welding guns is the extreme amount of heat generated by the gun. The heat may have a pronounced deleterious effect on the transformer and thus systems have been developed to dissipate the heat and to cool the transformer. In the use of prior art electrical resistance welders it has been customary to provide a cooling member through which a coolant is flowed for the purpose of cooling the transformer of the welding gun. The cooling member must be thermally conductive, to draw the heat from the transformer, and a cooling fluid or coolant is flowed through the cooling member. Typically, copper tubes are used as the cooling member because of the high thermal conductivity of the copper. However, the use of a cooling member increases the weight of a welding gun and the use of a metal cooling member increases not only the weight but also the resistance and the reactance of the welding gun.

Portable electrical resistance welding guns which are moved to a workpiece are often attached to "robots", i.e., programmable machines which move the welding gun to a desired position, cause the electrodes to close upon the workpiece, and control the application of the welding current through the electrodes to weld the workpiece.

If the electrical resistance welding gun is to be utilized with a robot, the use of a remote transformer and a long cable from the transformer to the electrodes still results in the energy loss problem described above. Thus, the present day approach to the use of electrical resistance welding guns in conjunction with robots dictates that the transformer will either be a structural part of the arm of the welding gun or attached to the arm of the welding gun. In either event, however, the use of a robot results in an additional problem, namely, the criticality of the weight of the transformer. Because of the combination of the speed at which robot-controlled welding guns are operated, especilly in the fabrication of vehicles, it is necessary to reduce the weight of the welding gun as much as possible. For example 3600 welds per hour is a desirable speed for a robot-controlled welding gun. At such a rate, which is one weld per second, the cycle of the robot-controlled welding gun would be: one-quarter second to move into welding position and grab the workpiece between the electrodes; one-quarter second to weld; one-quarter second to hold the welded workpiece while the weld cools; and one-quarter second to release the workpiece and move out of welding position. Since one-fourth of each cycle is the actual welding, such a system has a 25% duty cycle. With the prior art welding guns it was not possible to make a transformer of sufficiently light weight to be moved by the robot at the aformentioned rate while still providing cooling which would prevent the transformer from burning up at the 25% duty cycle. On the other hand, if the transformer (including the cooling member) was of a sufficient size to provide the necessary cooling at a 25% duty cycle, the transformer would be too heavy to be moved by robots operating at the desired speed of 3600 welds per hour. Thus, prior to the present invention, industrial robot-controlled welding guns used the technique of a large, remote transformer and a cable for transferring the welding power to the electrodes. This, of course, resulted in relatively inefficient, high energy loss systems.

The present invention overcomes the aforementioned problems relating to electrical resistance welders in general and in particular to electrical resistance welders for use in conjunction with a robot, by providing an improved transformer for an electrical resistance welding gun.

SUMMARY OF THE INVENTION

The present invention overcomes the prior art problems described above by providing a light-weight self-cooling electrical transformer for a welding gun and, more particularly, adaptable for use in a robot-controlled welding gun where it is attached to the welding gun arm, thereby eliminating the power loss of a long cable, where the transformer has a substantially reduced resistance and reactance, thus reducing the line current and power necessary to operate the electrical resistance welder, and with the transformer being of substantially reduced weight. The transformer thus may be used with high speed robots and provides sufficient cooling to avoid burning up of the transformer at high duty cycles.

This invention permits the design and manufacture of transformers having unusually varied application flexibility with minimal tooling and inventory. The novel windings may be designed to provide, through the variety of interconnection arrangements available, a plurality of voltage selections for both the primary and the secondary. Transformers for many varied welding applications may be assembled from a few "standard" primary coils and secondary turns.

Specifically, the present invention is directed to a light-weight, self-cooling transformer for the end of the arm of a robot-controlled electrical resistance welding gun. The transformer is characterized by windings that are closely coupled together both thermally and electrically.

Each secondary turn is preferably a single sheet-like element having two opposed generally planar surfaces. The secondary turns provide a large ratio of cross-sectional area to surface area and provide short thermal paths to the surfaces of the turns for heat developed as a result of the resistivity of the conductor and a large surface area from which the heat may be carried away. The incorporation of such secondary turns into transformers of the invention permits a transformer with a low secondary winding temperature rise, low secondary electrical losses and a high degree of coupling between the secondary and primary windings.

The primary winding is preferably a plurality of multi-turn coils formed with opposed generally planar side portions. At least some of the primary coils of the winding are wound with each turn of the conductor stacked on top of a proper turn to form coils with the exposed conductors of each turn lying in two substantially planar surface portions at each side of the coil. Such preferably primary and secondary coils are arranged with their generally planar side portions thermally coupled together but electrically isolated from each other.

The thermally coupled coils may be provided with means to remove the heat generated by the power loss within them. At least some of the coils of the primary wind may be wound with tubular conductor, and preferably a tubular conductor having a square-shaped perimeter. The primary coils formed with such conductors may have substantially flat surfaces at both sides of the coil and their ends may be connected with a source of coolant, such as running water, to provide means to carry heat away from the windings.

The primary and secondary windings may be insulated from each other and from the core in the manner known in the art. Barrier means may be interposed between each primary and its adjacent secondary. The barrier means provides electrical insulation to prevent a short between the primary and secondary windings and has limited thermal resistance so that coolant flowing through the primary coils will carry away heat from the secondary winding as a result of its conduction through the barrier to the primary coils.

The above features permit a light-weight, more compact transformer to be utilized at the high-duty cycles and to be particularly and easily adapted for a variety of uses as a welding transformer in a robot-controlled welding gun.

BRIEF DESCRIPTION OF THE DRAWINGS

The various objects and advantages of the present invention, together with other objects and advantages which may be attained by its use, will become more apparent upon reading the following detailed description of the invention taken in conjunction with the drawings.

In the drawings, wherein like reference numerals identify corresponding parts:

FIG. 4 is a front elevation view illustrating the configuration of both the secondary winding and the barrier means of the present invention.

DETAILED DESCRIPTION OF THE INVENTION

Figure 1:
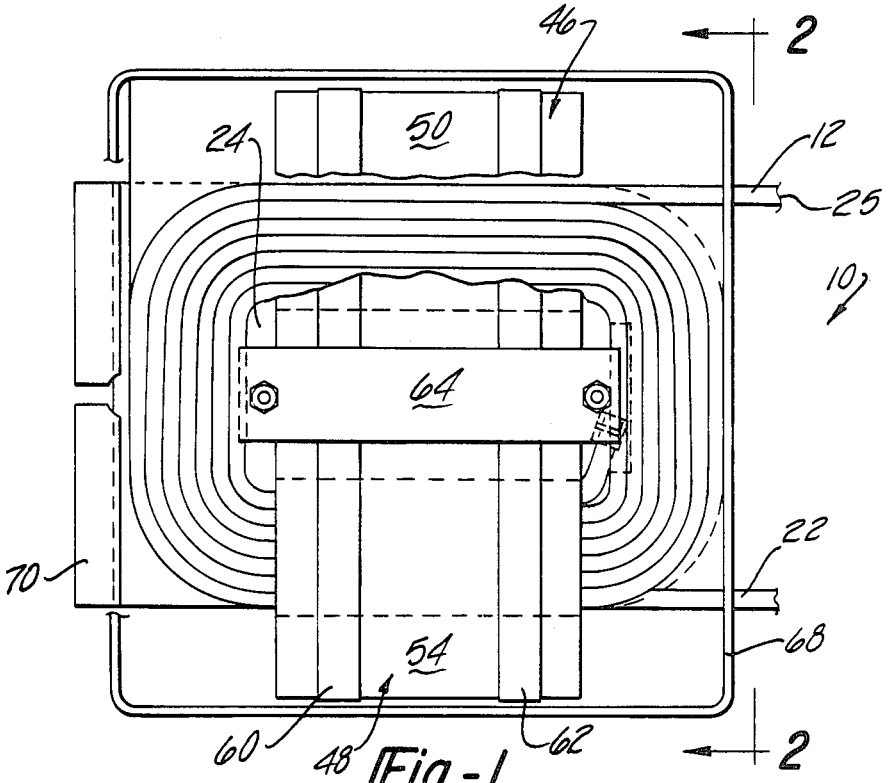
FIG. 1 is a front elevation view, partly broken away, of a transformer according to the principles of the present invention.
Figure 2:
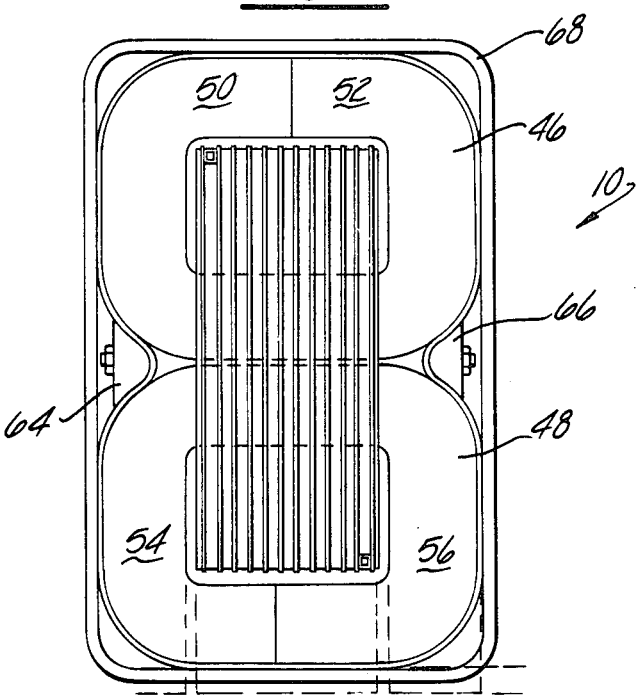
FIG. 2 is an end elevation view in the plane of arrows 2—2 of FIG. 1 illustrating the transformer of the present invention.
Figure 3:
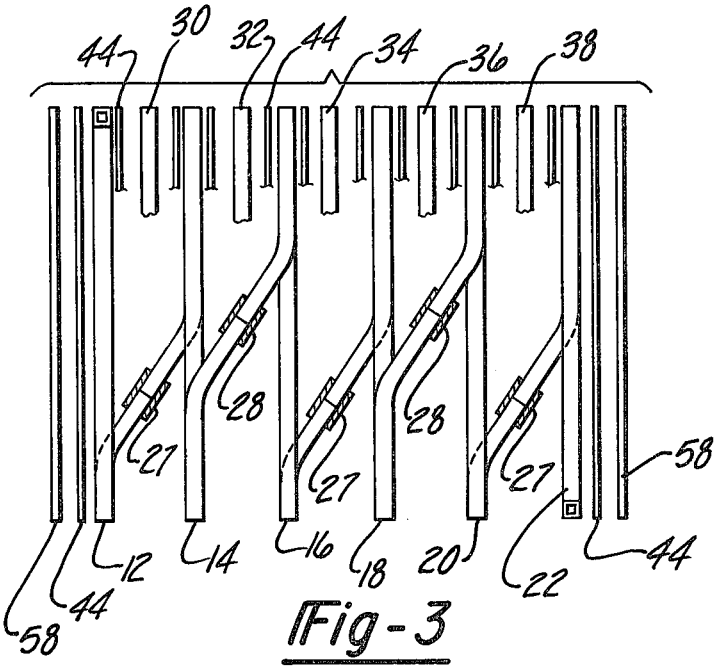
FIG. 3 is an end view, partially exploded, illustrating the primary windings of the present invention.
Figure 5:
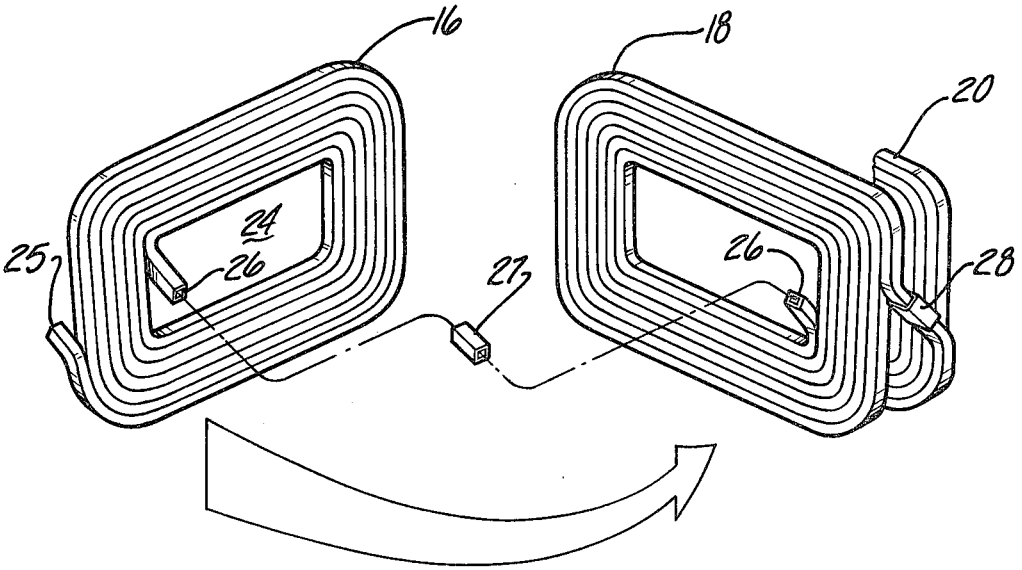
FIG. 5 is an exploded view illustrating several of the primary windings of the present invention and the connections therebetween.

The transformer 10 of the present invention is a self-cooled transformer adapted to be secured to an arm of an electrical resistance welding gun. The transformer includes a plurality of primary windings and six such primary windings 12, 14, 16, 18, 20 and 22 are illustrated in the drawings. Each primary winding comprises a plurality of turns of an electrical conductor with the plurality of turns formed as a flat oval pancake. According to the principles of the present invention, each primary winding may be formed of a hollow copper or aluminum tubing or hollow wire such a 0.635 cm square or 0.476 cm square and the tubing has a 0.3175 cm square hollow core. The tubular primary conductor provides a path for coolant flow and means for removing heat from the conductor. The tubing is electrically insulated before being wound into the flat, oval pancake form. Typically, a material such as Kapton by DuPont may be wound around the tubing and thereafter baked onto the tubing as the electric insulating material. Other electric insulations such as synthetic varnish may also be used. The use of such synthetic varnishes is known for use in electrical apparatus.

The number of turns per coil, number of coils, and size and shape of the tubular conductor may be designed to accommodate a variety of voltage and current capacities for any given size of magnetic core. The primary coils may be designed to permit their convenient interconnection to provide a variety of primary voltages suited to popular welding applications. Preferably, the primary coils are designed to be wound or interconnected in pairs and to present the connections to each pair at the outside of the windings.

A preferred technique for forming the transformer primary will now be explained. The transformer primary is preferably formed with a plurality of coils. Each primary coil is separately wound about a mandrel. When the mandrel is removed, each primary coil has a hollow central portion 24. Each primary winding coil, which is part of the primary, is initially a long straight section of hollow copper tubing with first and second ends 25, 26 respectively. Each coil is wound as a flat pancake with its "first" end at the outer periphery of the coil, i.e., extending outwardly of the coil, and with the "second" end at the center or interior periphery of the coil. Then the coils are connected together so that the electrical current flows in a continuous path, e.g., counter-clockwise in FIG. 1. Such connection is accomplished by first joining together the "second" ends of the first and second coils 12, 14 and by joining together the "second" ends of the third and fourth coils 16, 18, and by joining together the "second" ends of the fifth and sixth coils 20, 22. For convenience of manufacture the coils may be assembled as hereinafter described prior to actually connecting the coils to each other.

Joining the center or "second" ends of the aforementioned coils is preferably accomplished through the use of a short, straight, hollow metal connector 27 which may be swaged onto the ends of the coils. Preferably the connector 27 is made of copper. Thus as a first step in connecting the coils, the six coils are actually arranged in three "pairs" with coils 12 and 14 comprising the first pair, coils 16 and 18 comprising the second pair of coils, and coils 20 and 22 comprising the third pair of coils. The two coils within each "pair" of coils are joined by the connector 27 as heretofore described.

As an alternative technique for forming the preferred "pairs of coils", a "pair" of coils may be wound from a double length hollow copper tubing by starting at the center of the tubing and winding one half the length of the tube clockwise about a mandrel and the other half of the length of the tube counter-clockwise about a mandrel thus providing a continuous double coil.

Regardless of which of the aforementioned techniques is employed to form "pairs" of coils, each "pair" may be electrically connected to the next "pair" in order to provide a single continuous electrical path through the primary of the transformer. Means are provided to connect each "pair" of coils to the next "pair" of coils, specifically, a short, straight metal tube section or connector 28 may be swaged or welded onto the "first" ends of adjacent pairs of coils. Thus, a first connector 28 may be provided to connect the first pair of coils to the second pair of coils, e.g., connecting coil 14 to coil 16, and a second connector may be provided between coil 18 and coil 20 to connect the second pair of coils to the third pair of coils.

Where the primary coils are to be connected in parallel, the appropriate ends of the coils are provided with common tubular interconnections to provide a connection for the primary voltage source and for the source of coolant.

The primary winding as illustrated in a preferred embodiment of the present invention comprises a plurality of coils electrically connected in series to form a continuous electrical flow path where current flows in the same direction, e.g., counter-clockwise as viewed in FIG. 1. Since each primary coil is formed preferably from hollow tubing and since each of the connectors is a hollow metal member, a continuous interior flow path can be provided from the first end 25 of the first coil 12 to the first end 25 of the last coil 22. Thus such primary coils are both electrically and mechanically connected in a single, continuous path. This continuous path is such that both the electricity and a coolant flowing interiorly of the primaries, as will be described, each always flow in the same direction, e.g., counter-clockwise as illustrated in FIG. 1.

The transformer 10 of the present invention also includes a "secondary" comprising a plurality of thin copper plates 30, 32, 34, 36, and 38. A secondary turn or plate is preferably interposed between adjacent primary windings or coils and thus in the embodiment having six primary coils there will be five main secondary plates. One aspect of the present invention is that each secondary turn is preferably at least the same size as each primary winding. Thus, for example, if each primary coil is 12.7 cm high and 19.0 cm wide, then each secondary turn would be about 12.7 cm high and at least 19.0 cm wide.

The secondary windings 30, 32, 43, 36 and 38 are, for example, 0.3175 centimeters thick copper plate. In addition to these secondary turns, additional secondary turns 58 may be provided exteriorly of each of primary core 12 and 22 although secondary turns 58 are optional.

Thus, each secondary turn has a large effective cross-sectional area for the flow of secondary current and, therefore, correspondingly low resistance per turn. The low resistance per turn of the secondary winding contributes to a reduced power loss in the secondary of the transformer of this invention, and, therefore, to a reduced termperature rise, and contributes to the increase current capacity and high-duty cycle of transformers of this invention. Furthermore, the heat generated within each secondary turn, as a result of this electrical resistance, may readily be carried away from the large, substantially planar side surfaces of the secondary turns, an example of which is shown in FIG. 4. The short thermal path permits the heat to be more quickly removed from the turn as it is generated and particularly contributes to the secondary current capacity with duty cycles, characteristic of welding.

One side of each sheet-like secondary turn is severed as at 42 (FIG. 4) to provide an air gap and thus prevent short circuiting of each secondary turn. As a result, the secondary turns are preferably rectangular, somewhat C-shaped, and sheet-like with a central aperture 40 corresponding in location and size to the central opening 24 of each primary coil.

The secondary turns are generally connected in parallel to provide the secondary current capacity needed for welding. A copper strip may be welded to each secondary turn of each side of the air gap. To allow such connections to be made more easily, the length of each secondary turn may be made somewhat longer than the primary coils. For example, when the primary coil is 12.7 centimeters high and 19 centimeters long, the secondary turn could be made 12.7 centimeters high and 20 centimeters long to provide a projecting portion of the secondary turn for the connection. Where a number of the secondary turns are to be connected in parallel, it may be easier to alternate the placement of such longer secondary turns on the core so that they may be more easily interconnected in parallel at each side of the primary coil. The orientation and interconnection of the secondary turns to provide desired secondary voltage and current may be varied with the transformer design of varied applications.

Means are provided to electrically insulate each primary coil from its adjacent secondary turn. The electrical insulation may be electrical varnish and/or other insulating materials commonly used in transformer construction. Because of the controlled temperature rise with transformers of this invention, there is generally no need for special high temperature insulation. However higher temperature insulation will serve to extend the ife of a transformer if any problems such as leakage develop with the coolant. Preferably a plurality of barrier means 44 may be provided and one barrier means is interposed between each secondary winding and each primary winding. Each barrier means 44 is of the same size and shape as the secodary turn. The barrier means may be a material such as a glass cloth based polyester laminate sold by the Conolite division of LOF., having a thickness of 0.05 cm. Depending upon the specific transformer, the DuPont Kapton insulation may be a sufficient barrier, e.g., up to about 5 kv. Although these types of insulation are effective as barriers against electrical phenomena such as corona, their thermal conductivity is sufficiently high to allow passage therethrough of a substantial amount of the heat generated by the secondary windings.

The transformer includes magnetic core means such as upper and lower wound steel cores 46, 48, respectively, with each core comprising generally C-shaped opposed core halves. The core halves of the upper core 46, specifically core halves 50 and 52, are positioned so that the lower legs of each core half extend through the apertures 40 in each secondary, through the corresponding aperture in each barrier means, and through the center 24 of each of the primary coils. Similarly, the core halves 54, 56 of the lower core 48 are arranged so that one leg of each core half extends through the secondary apertures 40, the apertures in the barrier means, and the primary coil apertures 24.

It may be appreciated that there are barrier means 44 on each side of each primary coil. An additional secondary turn 58 may be provided exteriorly of each primary windings 12 and 22 although these secondaries 58 are optional. These additional secondary windings are rectangular shaped plates corresponding in both size and shape to the secondary windings 30, 32, 34, 36 and 38 but approximately only ½ the thickness. Thus, while the secondary windings 30, 32, 34, 36, 38 may be of 0.3175 cm thick copper plate, each additional secondary 58 would be 0.15875 cm thick copper plate. Preferably the primary and secondary winding, the barrier means and the core halves are all placed in proper alignment prior to securing the connectors which interconnect the primary windings to each other.

Means are provided for supporting and maintaining the transformer as a compact sub-assembly so that the transformer may be easily and quickly secured to the arm of a welding gun. By way of illustration, the transformer windings, cores and barrier means may be wrapped with electrically insulating material and thereafter encircled by a pair of spaced apart steel bands 60, 62 Clamping means are provided for securing the steel bands to the transformer, and the clamping means includes a pair of elongated metal plates 64, 66 positioned on opposite sides of the transformer. A pair of bolts are provided and each bolt extends through an aperture in the end of plate 64, through the central opening 40 in each secondary winding, through the corresponding opening in each barrier means 44, through the central aperture 24 of each coil and then through an aperture in the second plate 66. A nut may be placed on the end of each bolt to secure the plates together. In this fashion the transformer may be maintained as a compact assembly. The entire transformer as heretofore described may be housed inside an insulating case 68 which may be made of plastic.

In an electrical resistance welding gun the "secondary circuit" or "welding circuit" components are the electrodes and the secondary of the transformer. To facilitate connecting the transformer secondary to the welding gun electrode, a conventional secondary pad 70 may be provided from the secondary winding extending exteriorly of the insulating case. In addition, the free ends of the first primary coil 12 and of the last primary coil 22 both extend outwardly of the insulating case to permit both electrical and coolant connections. Although varioous coolants and cooling systems may be used, I prefer to use water as the coolant and a closed cooling system.

The present invention has yielded certain surprising and unexpected results when the transformer is operated and when a coolant is flowed through the hollow interior of the six primary coils. Specifically, with the transformer operating and providing 15 kiloamps welding current at a 25% duty cycle with 3600 welds per hour, water was flowed through the primary coils at the rate of 1.1 liter per minute. The temperature of the water entering the primary was about 15.5° C. The temperature of the water flowing out of the primary coils was about 57° C. The temperature of the secondary at the water inlet was about 35.5° C., which was about 20° C. higher than the inlet water temperature. The temperature of the secondary at the water outlet was about 78° C. which is also about 20° C. higher than the temperature of the outlet water. Thus notwithstanding the presence of thermal and electrical insulation (barrier means) the transformer is maintained sufficiently cool to prevent burning up or overheating the transformer.

The system as described may be modified for welding aluminum at double the current, i.e., 30 kiloamps. The modification includes first, more iron in the transformer, for the higher voltage required for welding aluminum and second, introducing water at the center of the primary and allowing the water to flow in two paths (one clockwise and one counter-clockwise) toward the two free ends of the primary.

The foregoing is a complete description of a preferred embodiment of the present invention. Various changes and modifications may be made without departing from the spirit and scope of the present invention. The invention should be limited only by the following claims.

What is claimed is:

1. In a transformer of the type adapted to be attached to the arm of a welding gun or the like including a primary winding, a secondary winding, and a core, the improvemment comprising:

said primary winding comprising a plurality of spaced apart coils, said primary winding coils having a hollow interior defining a passage for a coolant therein, said passage being configured to carry a quantity of said coolant which is sufficient to substantially cool both said primary winding and said secondary winding, said primary winding coils being electrically connected in series and mechanically connected to define a continuous flow path for said coolant;

said secondary winding comprising a plurality of thin flat members spaced apart from each other, said thin flat members being electrically and thermally conductive;

one of said primary coils being disposed in heat transferring relationship between two adjacent spaced apart secondary members so that primary coils and secondary windings are arranged in alternating sequence;

barrier means interposed between each primary coil and each secondary winding for electrically insulating each primary coil from the adjacent secondary winding, said barrier means having a sufficiently high thermal conductivity to allow a substantial portion of the heat generated in said secondary to be transferred through said barrier means to said primary coils;

each primary coil being of a first overall height and a first overall depth;

each secondary member being of substantially the same height and depth as said primary coil;

so that upon flowing a coolant through said primary winding, any heat generated in said transformer secondary winding is conducted through said barrier means to said primary winding and dissipated by the flow of coolant through said continuous flow path such that said transformer primary and secondary are both cooled by the flow of coolant through said primary.

2. The invention as defined in claim 1 wherein said plurality of coils comprises at least first and second pairs of coils, the coils for each pair of coils electrically and mechanically connected together and one end of said first pair of coils is electrically and mechanically connected to one end of said second pair of coils.

3. The invention as defined in claim 1 wherein said barrier means includes a plurality of plate-like members each of substantially the same height and depth as said primary coil.

4. A welding transformer having windings that are closely coupled both thermally and electrically, comprising:

a core of magnetic material, a primary winding having a plurality of multi-turn coils formed from an electrical conductor having at least two opposed planar side portions, at least some of the primary coils being wound with each turn stacked on top of the prior turn to form such coils with two substantially flat surface portions at each side of each coil, a secondary winding with a plurality of turns, each secondary turn being a sheet-lke element with two closely spaced, generally planar sides having a surface area at least substantially equal to the side area of the primary coils;

each secondary turn being located adjacent a primary coil with one of its generally planar side surfaces electrically insulated from, but thermally coupled to, the substantially flat portion of the adjacent primary coil, and means formed integral with one of said windings for removing heat from both of said windings and means for electrically insulating the planar side surfaces of each secondary turn from the substantially flat portion of the adjacent primary coil, said insulating means having a sufficiently high thermal conductivity to allow transfer there-through of a substantial portion of the heat generated in the other of said windings.

5. The transformer of claim 4 wherein some of the primary coils are formed from a tubular conductor so that each such primary coil is formed with substantially flat surfaces at both sides of the coil, and the ends of the primary coils of tubular conductor are connectable with a source of coolant to provide means to carry heat away from the windings.

6. The transformer of claim 5 wherein each of the primary coils is wound with tubular conductor having a square perimeter and the majority of sheet-like secondary turns are located between two adjacent primary coils so that each generally planar side of a majority of secondary turns is thermally coupled with the substantially flat surfaces of the adjacent primary coil at each of its sides to permit heat to be carried away by the coolant.

7. A welding transformer, comprising:

a core of magnetic material, a primary winding having a plurality of primary coils, each primary coil being wound turn upon turn from a tubular conductor to provide a pancake configuration;

a secondary winding having a plurality of turns, each secondary turn comprising a single, generally C-shaped sheet having two closely spaced, opposed planar surfaces to provide a large surface for transferring the heat generated by the power loss of the turn, said primary and secondary windings being alternately disposed in side-by-side, heat transferring relationship to each other;

means extending between said primary and secondary windings for electrically insulating said primary and secondary windings from each other but allowing transfer of heat therethrough from said secondary winding to said primary winding; and means on said primary winding for carrying away heat generated by both said primary and secondary windings.

8. The transformer of the claiim 7 wherein said means for carrying away heat includes a tubular conductor having a square perimeter adapt to carry a coolant and the majority of sheet-like secondary turns are located between two adjacent primary coils so that each generally planar side of a majority of secondary turns is thermally coupled with the substantially flat surfaces of the adjacent primary coil at each of its sides to permit heat to be carried away by the coolant.

* * * * *